United States Patent [19]

Kuzuno et al.

[11] Patent Number: 4,850,890

[45] Date of Patent: Jul. 25, 1989

[54] MULTIPOLAR CONNECTOR

[75] Inventors: Katsutoshi Kuzuno; Shigeo Ishizuka; Kazuaki Sakurai, all of Shizuoka, Japan

[73] Assignee: Yazaki Corporation, Japan

[21] Appl. No.: 200,064

[22] Filed: May 27, 1988

[30] Foreign Application Priority Data

May 29, 1987 [JP] Japan ..... 62-131238
Sep. 3, 1987 [JP] Japan ..... 62-219018
Jan. 14, 1988 [JP] Japan ..... 63-4951

[51] Int. Cl.[4] ..... H01R 13/629
[52] U.S. Cl. ..... 439/310; 439/314
[58] Field of Search ..... 439/296, 299, 310, 314, 439/316, 342

[56] References Cited

U.S. PATENT DOCUMENTS 3,392,245 7/1968 Asick .
4,586,771 5/1986 Kraemer et al. .

FOREIGN PATENT DOCUMENTS 61-203581 9/1986 Japan .

*Primary Examiner*—Joseph H. McGlynn
*Attorney, Agent, or Firm*—Wigman & Cohen

[57] ABSTRACT

A multipolar connector comprises male and female terminals disposed in recessed and projected housings and electrically connected to each other by fitting the recessed and projected housings to each other; guide rails disposed in one of the recessed and projected housings; a slider slidably attached to the guide rails and having a cam follower and moved along the guide rails so that the recessed and projected housings are moved towards and away from each other; the one of the recessed and projected housings having a space for allowing the movement of the cam follower; and a guide groove disposed in the other of the recessed and projected housings and engaged with the cam follower through the space.

A multipolar connector for fitting a projected housing having a plurality of female terminals and a recessed housing having a plurality of male terminals to electrically connect the male and female terminals to each other. The connector comprises a pair of parallel guide rails disposed in a side wall of a cover portion of the recessed housing for receiving projected housing and extending in a direction perpendicular to the axis of the terminals; a slider slidably attached to the guide rails; a cam follower disposed on the lower surface of the slider; a space disposed in the cover portion and allowing the movement of the cam follower; and a guide groove disposed in a side wall of the projected housing and engaged with the cam follower through the space; the projected housing being moved towards and away from the recessed housing by moving the slider along the guide rails.

13 Claims, 29 Drawing Sheets

MULTIPOLAR CONNECTOR

The present invention relates to a multipolar connector for fitting and separating projected and recessed housings having a plurality of male and female terminals by a small force.

BACKGROUND OF THE INVENTION

Japanese Laid-Open Pat. No. 61-203581 discloses a structure in which first and second connector housings are fitted and separated from each other by a small force by using a cam mechanism. The cam mechanism is constructed by two slots disposed within the first housing and aligned with each other, a cam track disposed within the second housing, and a cam follower disposed on a cam following slide. The cam following slide is a U-shaped one composed of a pair of parallel arms extending from webs. Each of the arms has a length approximately equal to the distance between end walls of a flange forming a hood in the first housing for receiving the second housing. The cam follower is disposed on the inner surface of each arm.

In accordance with the cam mechanism, the cam following slide must be disposed perpendicular to the fitting direction of the first and second housings. Accordingly, it is necessary to dispose an attaching space sufficiently wider than the length of the slide on one side of the connector, thereby causing problems with respect to the operability when the connectors are fitted and separated from each other in a small space such as a dashboard of a vehicle. Further, the cam following slide is slided by guiding the cam follower by the slot so that it is necessary to dispose two slots aligned with each other on one side so as to prevent the cam following slide from being rotated by the rotation moment. Correspondingly, it is necessary to dispose two tracks on one side so that the inclinations thereof are increased and a relatively large force is needed to fit and separate the connector housings from each other.

U.S. Pat. No. 4,586,771 discloses a structure in which first and second connector housings are fitted and separated from each other by a small force by using a cam mechanism, as in the first prior art. The cam mechanism is constructed by two slots disposed within the first housing and aligned with each other, cam tracks disposed within the second housing, and a cam following slide provided with a cam follower disposed in the first housing.

In this conventional structure, the cam follower for moving the cam tracks is separated from a web to which a force is applied to slide the cam following slide, so that a rotation moment is generated and a relatively large force is needed to fit and separate both housings. Further, in this structure, two cam tracks and two guide slots aligned with each other are disposed to prevent the cam following slide from being rotated by the rotation moment, but the two cam tracks have the same inclination, so that the connectors tend to be fitted to each other in an offset state and rattles tend to be generated.

SUMMARY OF THE INVENTION

To overcome the problems mentioned above, an object of the present invention is to provide a multipolar connector easily fitted and separated by a small force in a small limited space.

Another object of the present invention is to provide a multipolar connector in which the complete fitting of recessed and projected housings can be easily confirmed and the housings can be locked in the completely fitting state.

Another object of the present invention is to provide a multipolar connector which is engagable with a wall of a panel, an electrical device, etc.

With the above objects in view, the present invention resides in a multipolar connector comprising male and female terminals disposed in recessed and projected housings and electrically connected to each other by fitting the recessed and projected housings to each other; guide rail means disposed in one of the recessed and projected housings; slider means slidably attached to the guide rail means and having a cam follower means and moved along the guide rail means so that the recessed and projected housings are moved towards and away from each other; said one of the recessed and projected housings having a space for allowing the movement of the cam follower means; and guide groove means disposed in the other of the recessed and projected housings and engaged with the cam follower means through said space.

In accordance with another embodiment, the present invention resides in a multipolar connector for fitting a projected housing having a plurality of female terminals and a recessed housing having a plurality of male terminals to electrically connect the male and female terminals to each other. The connector comprises a pair of parallel guide rails disposed in a side wall of a cover portion of the recessed housing for receiving projected housing and extending in a direction perpendicular to the axis of the terminals; slider means slidably attached to the guide rails; a cam follower disposed on the lower surface of the slider means; a space disposed in the cover portion and allowing the movement of the cam follower; and guide groove means disposed in a side wall of the projected housing and engaged with the cam follower through the space; said projected housing being moved towards and away from the recessed housing by moving the slider means along the guide rails.

BRIEF DESCRIPTION OF THE DRAWINGS

The present invention will be more apparent from the following description of the preferred embodiments thereof in conjunction with the accompanying drawings in which:

FIGS. 35A to 35D are respectively front, side, rear and plan views of a pair of sliders in accordance with another embodiment of the present invention in which FIG. 35B is the side view taken along line Y—Y of FIG. 35A;

DETAILED DESCRIPTION OF THE PREFERRED EMBODIMENTS

The preferred embodiments of the present invention will be now described in detail with reference to the accompanying drawings.

Figure 1:
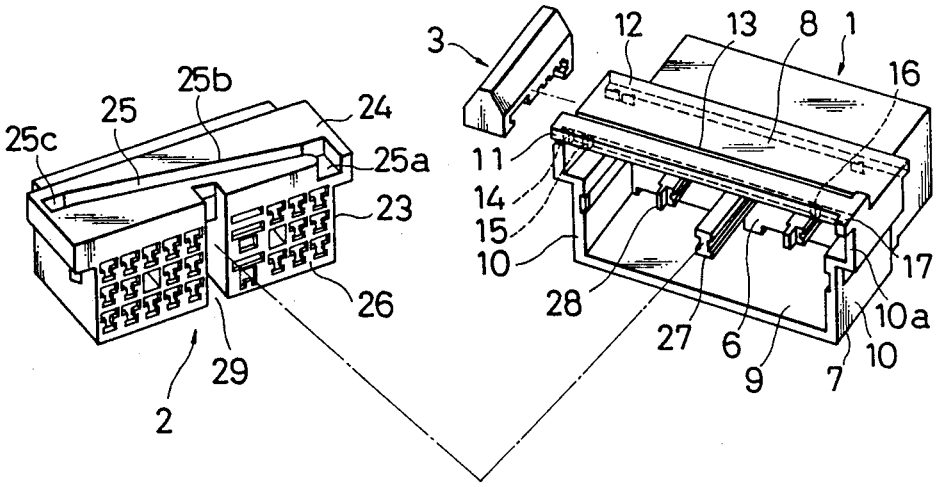
FIG. 1 is an exploded perspective view of a multipolar connector in accordance with a first embodiment of the present invention.
Figure 2:
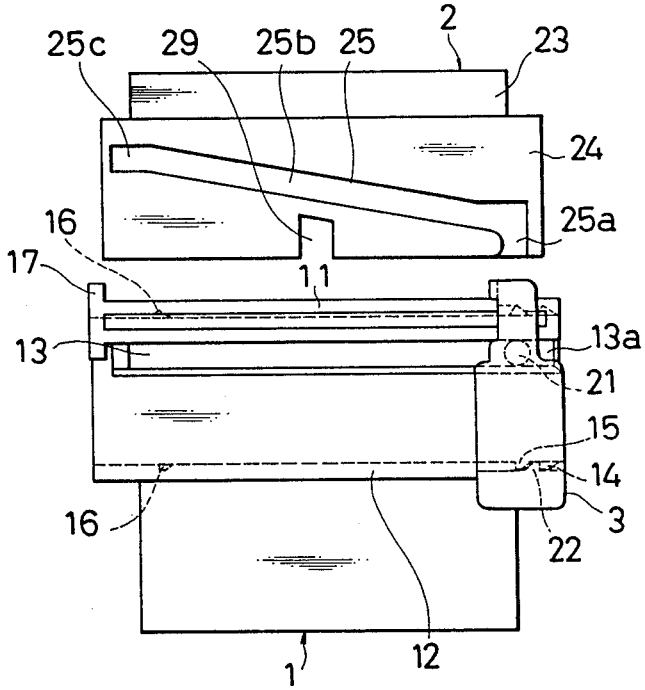
FIG. 2 is a plan view of the multipolar connector having a slider of FIG. 1.
Figure 3:
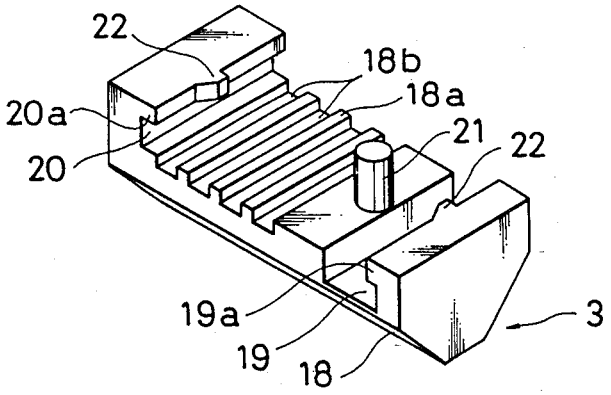
FIG. 3 is a perspective view of the slider of FIG. 1 seen from below.
Figure 7:
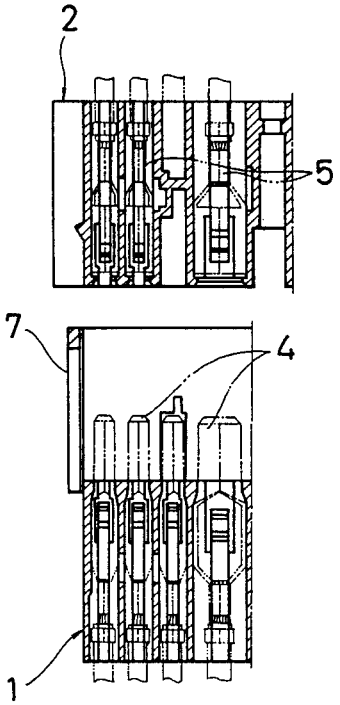
FIG. 7 is a cross-sectional view of portions of projected and recessed housings of FIG. 4.

FIGS. 1 to 3 show a recessed housing 1, a projected housing 2, and a slider 3. As shown in FIG. 7, a plurality of male and female terminals 4 and 5 are respectively disposed within the housings 1 and 2. The recessed housing 1 has a cover portion 7 receiving the projected housing 2 and disposed in front of a fitting face 6. The cover portion 7 is formed by a frame composed of upper and lower opposite side walls 8 and 9, and right and left end walls 10. An upper portion of the end walls 10 contacts both ends of the side wall 8 through enlarged portions 10*a* expanded outwards. A pair of parallel guide rails 11 and 12 for the slider 3 is disposed in the side wall 8, and the side wall 8 has a slot 13 opening at one end thereof (on the lefthand side of FIG. 1).

The guide rail 11 is formed to be high by one step along the front edge of the side wall 8, and the guide rail 12 is extended from the rear edge of the side wall 8, thereby forming a stepped structure. At least one of the ends of the slot 13 opens, and in this embodiment, the slot 13 has an opening 13*a* at one end thereof, and is disposed in the vicinity of the forward guide rail 11. An engaging projection 14 and a provisional engaging projection 15 with respect to the slider 3 are disposed on the side of the opening 13*a* and below the respective guide rails 11 and 12. An engaging projection 6 is disposed on the other side opposite the side of the opening 13*a* and below the guide rails 11 and 12. A stopper 17 for the slider 3 is projected on the terminal side (on the righthand side of FIG. 1) of the guide rail 11.

The slider 3 has inserted grooves 19 and 20 for the guide rails 11 and 12 having a stepped structure and disposed on the lower both sides of a pressing portion 18 having an L-shaped projection, and a cylindrical cam follower 21 disposed on a central face of the pressing portion 18. Self-locking engaging projections 22 are disposed on the inner end faces of groove bottom walls 19*a* and 20*a* of the inserting grooves 19 and 20, and are engaged with the engaging projections 14 to 16. As shown in FIG. 3, a plurality of recessed portions 18*b* are preferably disposed on the lower face of the pressing portion 18, i.e., on a sliding face 18*a* in slide contact with the side wall 8 so as to reduce the sliding resistance.

The projected housing 2 has an enlarged plate portion 24 disposed in an upper portion of a body 23 for housing female terminals and aligned with the enlarged portion 10*a* of the covering portion 7, and a guide groove 25 engaged with the cam follower 21 and disposed in the plate portion 24. The guide groove 25 is composed of an inlet portion 25*a* extending inwards from a fitting face 26 of the projected housing 2, an intermediate portion 25*b* slantingly extending towards the rear side of the inlet portion 25*a*, and an outlet portion 25*c* extending in parallel to the fitting face 26.

The recessed and projected housings 1 and 2 are formed as a large-sized multipolar connector. As shown in FIG. 1, a longer fitting guide bar 27 is disposed in a central portion of the fitting face 6 of the recessed housing 1, and shorter fitting guide bars 28 are disposed on both sides of the fitting face 6. A recessed portion 29 is disposed corresponding to the fitting face 26 of the projected housing 2. Such an arrangement is preferable to prevent the reverse connection of the connector and prevent the housings 1 and 2 from being twisted when the slider 3 is operated as described later.

As shown in FIG. 2, the slider 3 is slidably inserted in advance into the inserting grooves 19 and 20 corresponding to the guide rails 11 and 12 from the side of the opening 13*a* of the slot 13 in the recessed housing 1. In FIG. 2, the cam follower 21 of the slider 3 is guided into the interior of the recessed housing through the opening 13*a* of the slot 13, and the self-locking engaging projections 22 of the inserting grooves 19 and 20 are temporarily locked between the engaging projection 14 and the provisional engaging projection 15 in the guide rails 11 and 12. Since the slider 3 is slided along the two guide rails 11 and 12, the width of the slot 13 is freely set within a range for allowing the movement of the cam follower 21.

Figure 4:
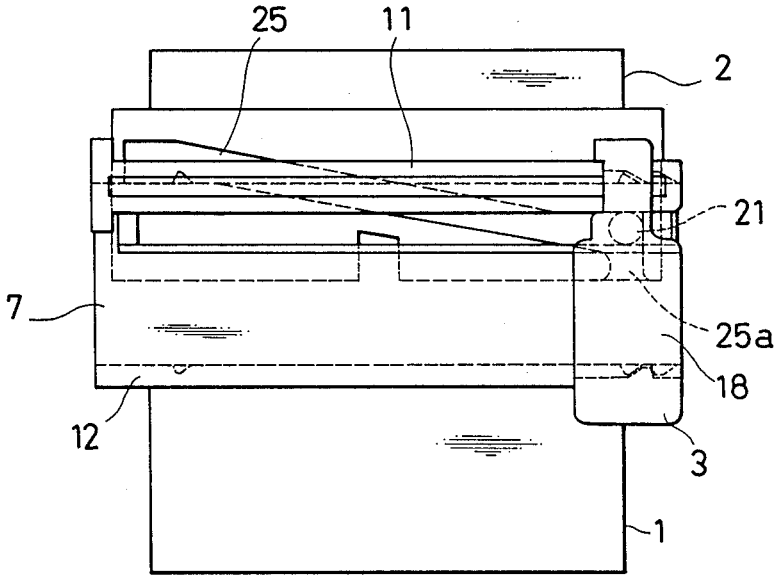
FIGS. 4 to 6 are plan views showing a fitting state of the connector of FIG. 1.
Figure 5:
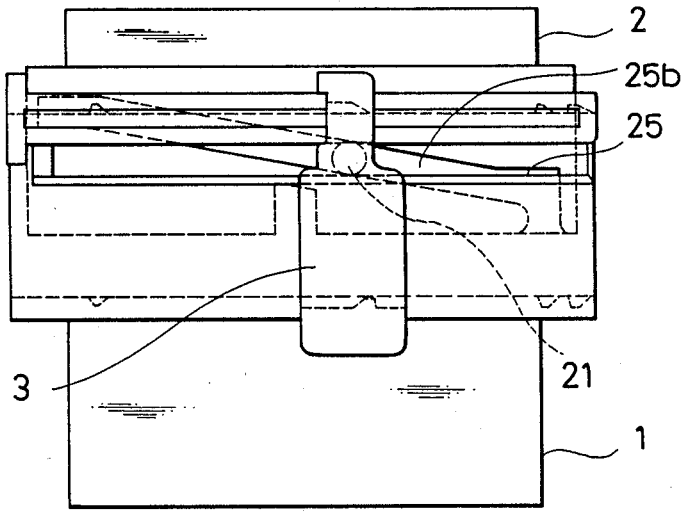
Figure 6:
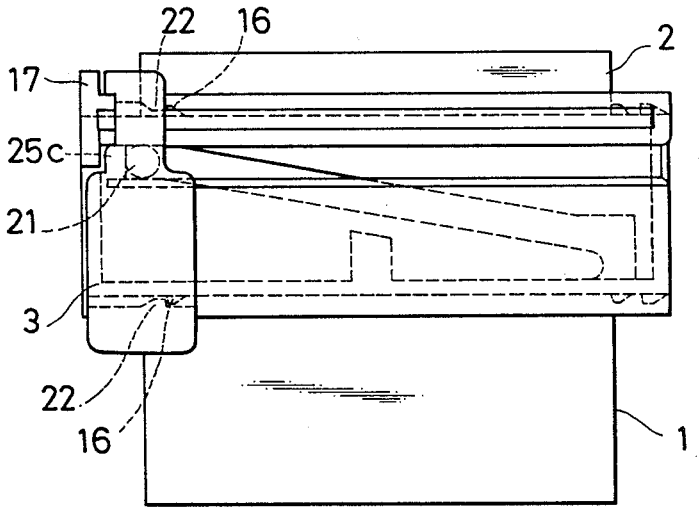

The housings 1 and 2 are fitted to each other as shown in FIGS. 4 to 6.

First, the projected housing 2 is inserted into the covering portion 7 of the recessed housing 1 until the temporarily locked can follower 21 of the slider 3 reaches a deep wall of the inlet portion 25*a* of the guide groove 25 as shown in FIG. 4. Thus, tip portions of the male and female terminals 4 and 5 shown in FIG. 7 become very close to each other just before the contacting state thereof, thereby starting the fitting operation later.

Subsequently, when the sliding 3 is moved leftwards as shown in FIG. 5, the projected housing 2 approaches the recessed housing 1 by the guide groove 25 engaged with the cam follower 21. The cam follower 21 comes in slide contact with the intermediate portion 25*b* having a gentle inclination in the guide groove 25 so that the fitting operation can be performed by a small force.

FIG. 6 shows a state of the completion of the fitting operation in which the cam follower 21 is located in the outlet portion 25*c* of the guide groove 25, and the slider 3 contacts the stopper 17 and is locked by the engagement between the self-locking engaging projection 22 and the engaging projections 16 of the guide rails 11 and 12.

The housings 1 and 2 can be detached or separated from each other by the operation reverse to the above operation. When the slider 3 is operated while pressing the central portion of the angle pressing portion 18, i.e., the intermediate portion of the two guide rails 11 and 12 by fingers, no rotation moment is almost generated and it is not necessary to apply an additional force to the connector. Since the slider 3 is disposed in the recessed housing 1 in advance, it is enough for the operator to simply operate the slider, thereby performing no complicated operation from one sides of the housings as in the conventional connector. Further, since it is not necessary to dispose an attaching space for the slider, the connector can be connected and disconnected in a small space.

Figure 11:
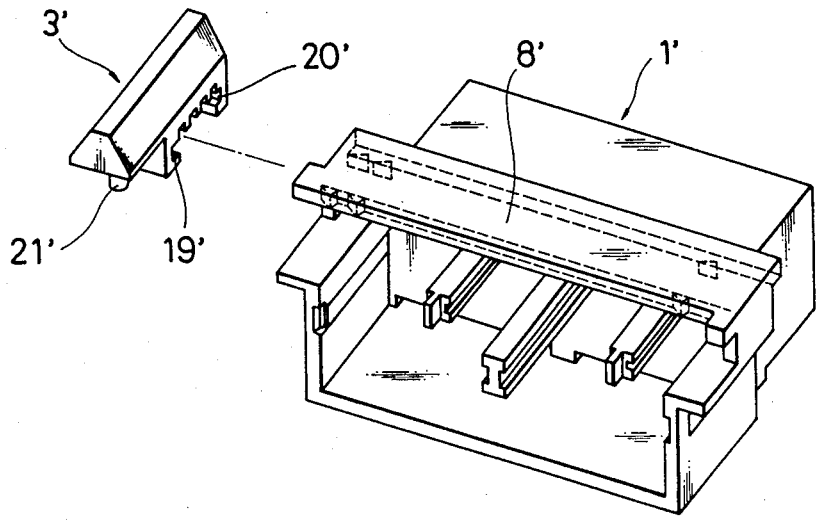
FIG. 11 is an exploded perspective view showing another embodiment of the slider and the recessed housing.

As another embodiment, as shown in FIG. 11, a slider 3' may be constructed by a structure in which a cam follower 21' is formed at one end of the slider 3' and rail guide portions 19' and 20' are opposite each other and a front edge of a side wall 8' of a recessed housing 1' is cut off to form a movable space for the cam follower 21'.

Figure 8A:
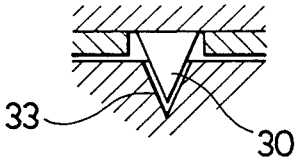
FIGS. 8A to 8C are cross-sectional views showing another embodiments of a cam follower and a guide groove.
Figure 8B:
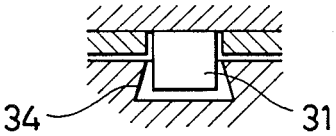
Figure 8C:
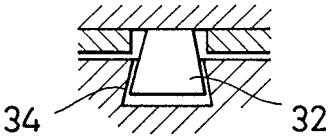

FIGS. 8A to 8C show another embodiments of the cam follower and guide groove in which cam followers 30, 31 and 32 respectively have conical, cylindrical and trapezoidal shapes and corresponding guide grooves 33 and 34 have a triangular cross section and trapezoidal cross sections. The structure of FIG. 8C having the trapezoidal cam follower and guide groove can be also used to prevent the slider and guide groove from being extracted from each other.

Figure 9:
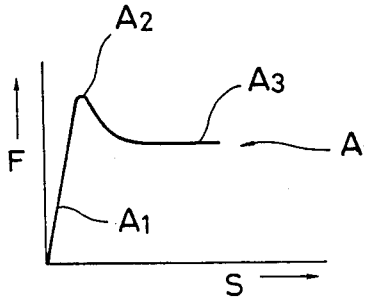
FIG. 9 is a graph showing the relation between a stroke and a fitting force when the projected and recessed housings are fitted to each other.

FIG. 9 shows a graph showing the relation between a stroke S and a fitting force F when both housings are fitted to each other, with respect to the connecting state of the male and female terminals. As shown by curve A, the fitting force F is rapidly increased by static friction in portion $A_1$, and reaches peak $A_2$, and then becomes constant as shown by constant portion $A_3$ by dynamic friction, completing the fitting operation.

Figure 10A:
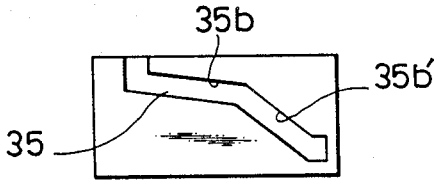
FIGS. 10A to 10C are plan views showing another embodiments of the guide groove.
Figure 10B:
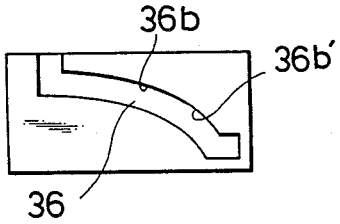
Figure 10C:
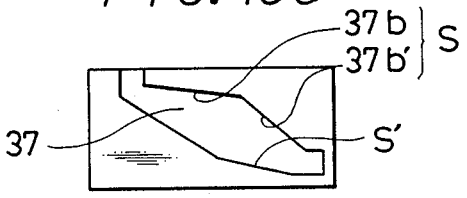

FIG. 1 shows a state in which the inclination of the intermediate portion of the guide groove 25 is constant, but various kinds of guide grooves 35, 36 and 37 having inclinations corresponding to the change in curve A can be formed as shown in FIGS. 10A to 10C. The respective guide grooves have intermediate portions 35*b*, 36*b* and 37*b* having gentler inclinations, and subsequent intermediate portions 35*b'*, 36*b'* and 37*b'* having larger inclinations. In FIG. 10C, slanting face S at the fitting time and slanting face S' at the separating time are formed reversely with respect to each other.

As mentioned aboe, in a mutlipolar connector in accordance with the present invention, since a slider constituting a cam mechanism for fitting or separating projected and recessed housings is disposed in one of the housings, e.g., the recessed housing at any time, the connecting operation can be performed within a limited small space. Further, since the slider is slided along two guide rails, any useless force such as rotation moment is not applied to the connector, and a single guide groove engaged with the cam follower may be disposed, so that the inclination of the guide groove can be made gentle, thereby reducing the force required to fit and separate both housings from each other.

Figure 12:
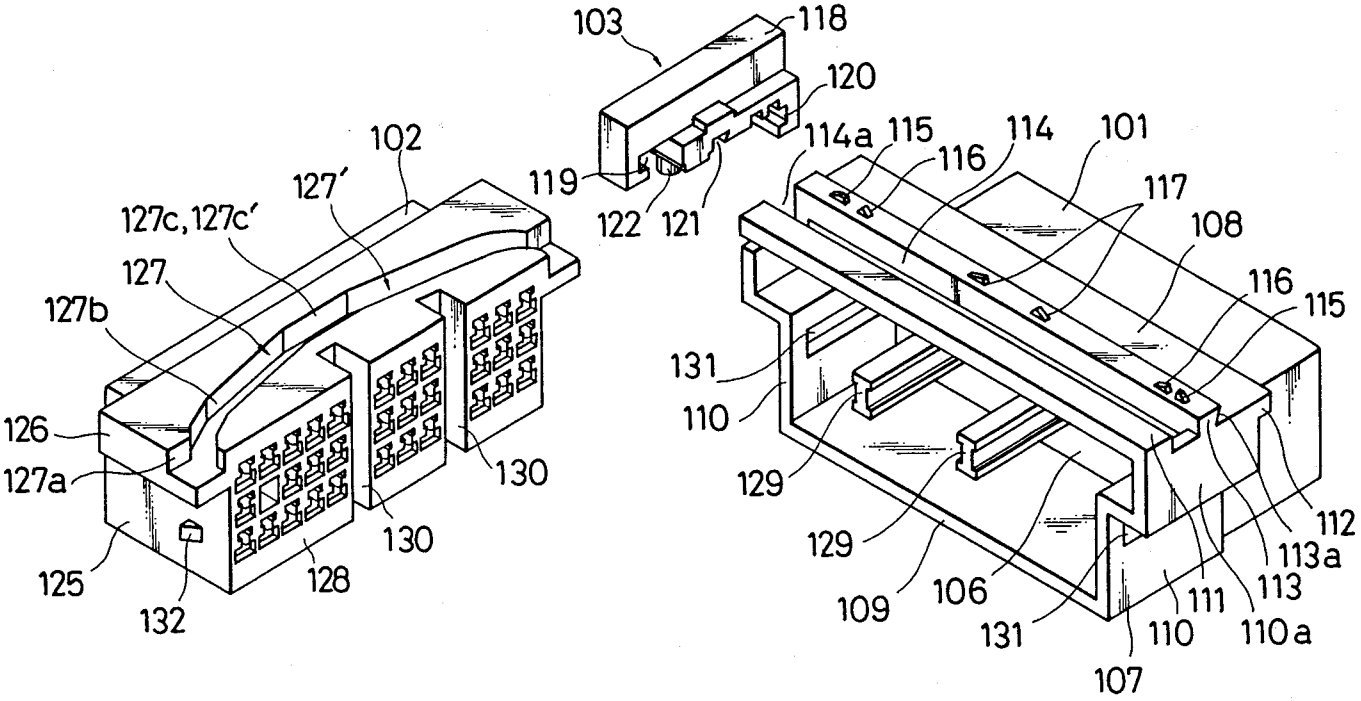
FIG. 12 is an exploded perspective view showing a multipolar connector in accordance with a second embodiment of the present invention.

FIG. 12 shows a second embodiment of the present invention. In this embodiment, recessed and projected housings 101 and 102, a slider 103, and male and female terminals 104 and 105 are similar to those in the first embodiment shown in FIG. 1.

A side wall 108 has a pair of guide rails 111 and 112 for the slider 103 disposed in parallel to each other, a holding rail 113, and a slot 114 having an opening 114*a* at one end thereof (on the lefthand side of FIG. 12). The guide rail 111 is formed to be high by one step along the front edge of the side wall 108, and the guide rail 112 is extended from the rear edge of the side wall 108, thereby forming a stepped structure. The holding rail 113 is disposed to prevent the slider 103 from floating from the side wall 108 and being disengaged therefrom when the slider 103 is slided, as described later. The holding rail 113 has a reversely trapezoidal shape in cross section and is disposed between the guide rails 111 and 112. The shape in cross section of the holding rail 113 may be formed such that a base portion of the holding rail 113 is narrower than that of an end portion thereof. Accordingly, the holding rail 113 may be formed in an arbitrary shape such as character T or a sector. The opening 114*a* of the slot 114 disposed in at least one end portion thereof is used to attach therefrom the slider 103 to the recessed housing 101. The slot 114 is disposed in a forward portion of the side wall 108 and in the vicinity of the guide rail 111. The holding rail 113 has a pair of engaging projections 115 and 116 for holding the slider 103 in an opening position at both rail ends, and engaging projections 117 for holding the slider 103 in a closed position in a central rail portion.

Figure 13:
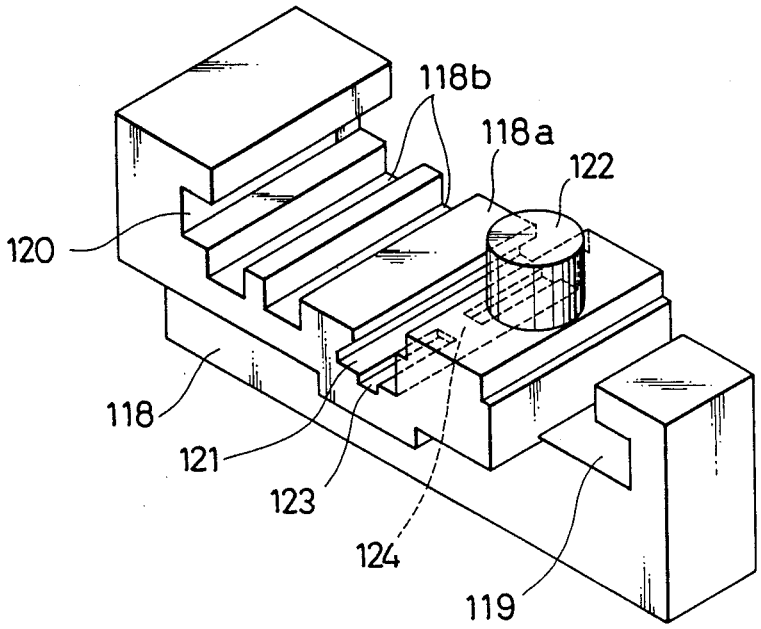
FIG. 13 is an enlarged perspective view of a slider of FIG. 12 seen from below.

The slider 103 has inserting grooves 119 and 120 for the guide rails 111 and 112 having the stepped structure, and the inserting grooves are disposed on lower both sides of a beam-shaped grip portion 118. The slider 103 further has a holding groove 121 disposed in an intermediate portion thereof and fitted to the holding rail 113, and a cylindrically projecting cam follower 122 disposed between the holding groove 121 and the inserting groove 119. As shown in FIG. 13, an elongated groove 123 forming passages of the engaging projections 115 to 117 is disposed in the bottom of the holding groove 121. A projection 124 engaged with the engaging projections 115 to 117 is disposed in a central portion of the elongated groove 123. A plurality of recessed portions 118*b* are preferably disposed on the lower face of the grip portion 118, i.e., a slide face 118*a* of the slider 103 in slide contact with the side wall 108 so as to reduce the slide resistance.

An enlarged plate portion 126 is disposed in an upper portion of a body 125 of the projected housing 102 for housing the female terminals 105 and is aligned with an enlarged portion 110*a* of the cover portion 107. A pair of cam tracks 127 and 127' engaged with the cam follower 122 are disposed in the enlarged plate portion 126. Each of the cam tracks 127 and 127' is composed of an inlet portion 127*a* extending inwards in both end portions of the fitting face 128 of the projected housing 102 with respect to the recessed housing 101, an intermediate portion 127*b* slantingly extending backwards from the inlet portion 127*a*, and a terminal portion 127*c* extending in parallel to the fitting face 128. In this embodiment, the terminal portions 127*c* and 127*c'* of the pair of cam tracks 127 and 127' are joined to each other, forming a contiguous cam track having right and left symmetry.

Figure 16:
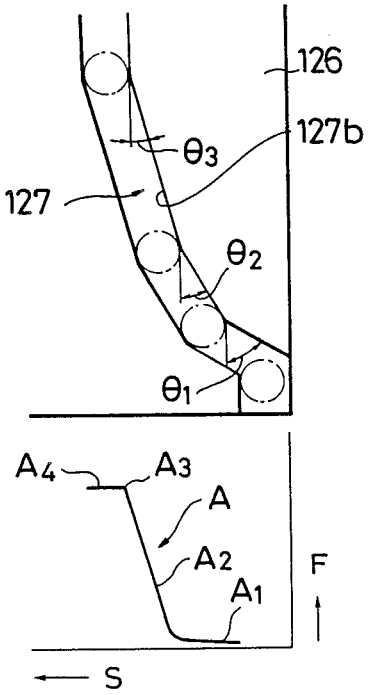
FIG. 16 is a view for explaining the relation between the inclination of a cam track and an inserting force of the housing in FIG. 14.

The inclination of the intermediate portion 127*b* in each of the cam tracks 127 and 127' is changed by three stages as shown in FIG. 16 in which the inclination angle of the slanting face are changed by $\theta_1$, $\theta_2$ and $\theta_3$ from the inlet portion 127*a*. In this case, the condition of $\theta_1 > \theta_2 > \theta_3$ is preferable. When both housings 101 and 102 are fitted to each other, the inclination angle is increased in a place in which inserting force F at the beginning of the fitting operation is small, increasing stroke S, and reducing the width of both housings 101 and 102, which is a depth required to form the cam track, as narrow as possible.

As shown in FIG. 12, since the recessed and projected housings 101 and 102 are formed in a large-sized shape as a multipolar connector, a plurality of elongated fitting guide bars 129 are disposed on the fitting face 126 of the recessed housing 101, and recessed portions 130 corresponding to the fitting face 128 of the projected housing 102 are disposed to prevent the reverse connection of the connector. A locking hole 131 and a locking claw 132 constitute a locking means of both housings 101 and 102.

The connection and disconnection of the housings 101 and 102 by the slider 103 will be described next.

Figure 14:
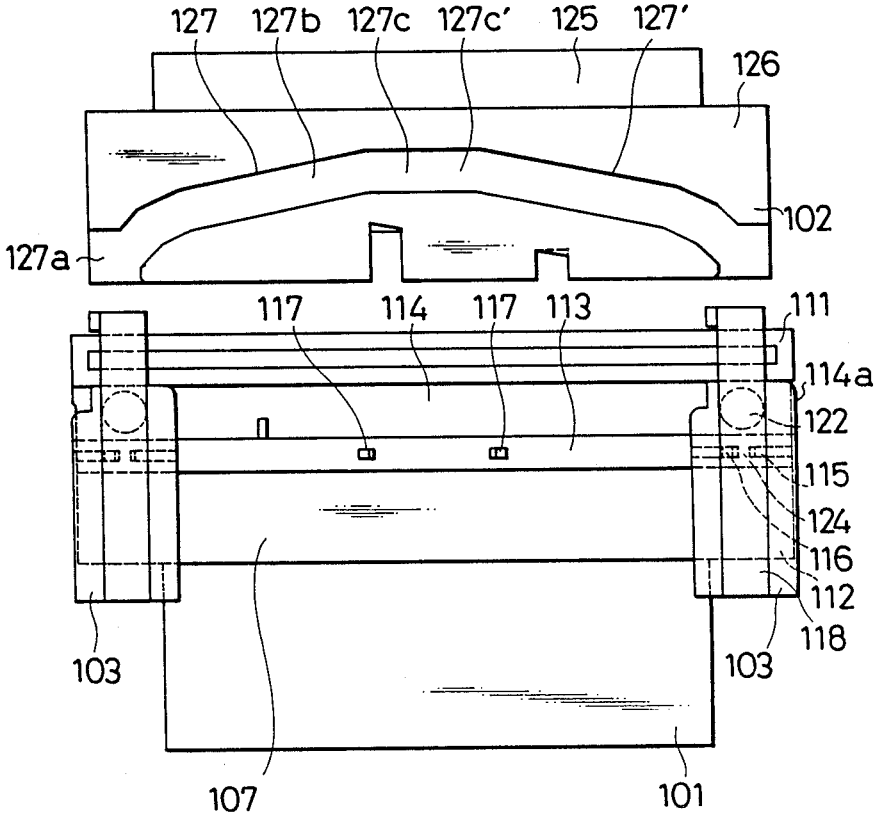
FIG. 14 is a plan view showing a state in which the slider is attached to a recessed housing in FIG. 12.

As shown in FIG. 14, each of the sliders 103 is slidably attached to the recessed housing 101 in advance by inserting it into the inserting grooves 119 and 120 and the holding groove 121 corresponding to the guide rails 111 and 112 and the holding rails 113, from the side of the opening 114*a* of the slot 114 of the recessed housing 101.

In FIG. 14, the cam follower 122 of each of the sliders 103 is guided into the slot 114 through the opening 114*a* thereof, and the projection 124 of the elongated groove 123 in the holding groove 121 is engaged with the recessed portion between the pair of engaging projections 115 and 116 in both end portions of the holding rail 113. Thus, the sliders 103 are respectively temporarily locked in both end portions of the cover portion 107, resulting in an attaching state or an opening portion thereof. Since the sliders 103 are slided along the two guide rails 111 and 112 and the holding rail 113, it is not necessary to let the slot 114 guide the cam follower 122. Accordingly, the width of the slot 114 is freely set to be narrow or wide if it has a size for allowing the movement of the cam follower 122.

Figure 17:
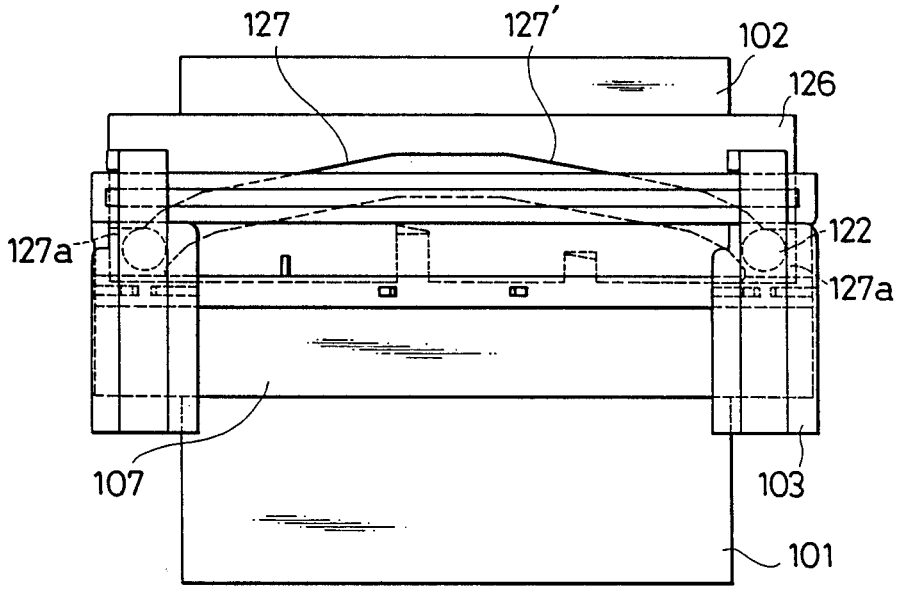
FIGS. 17 to 19 are respectively plan views showing the fitting processes of the connector.
Figure 18:
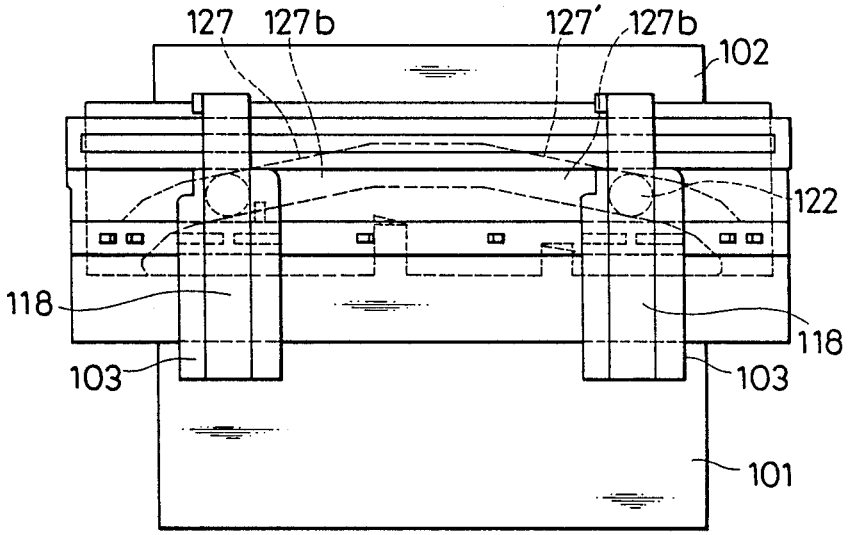
Figure 19:
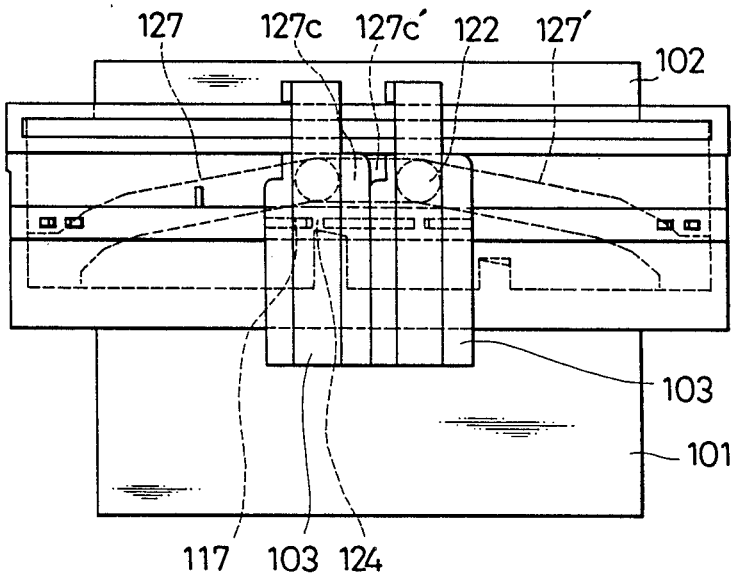

Both housings 101 and 102 will be fitted to each other as shown in FIGS. 17 to 19.

Figure 15:
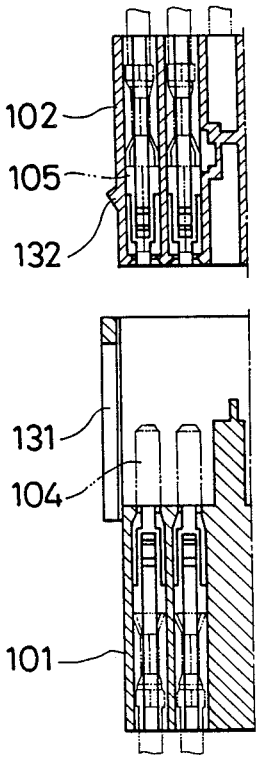
FIG. 15 is a horizontally cross-sectional view of a central portion of the slider of FIG. 14.

First, the projected housing 102 is inserted into the cover portion 107 of the recessed housing 101 until the cam follower 122 of each slider 103 temporarily locked reached a deep wall of the inlet portion 127*a* of the cam track 127 as shown in FIG. 17. Thus, the end portions of the male and female terminals 104 and 105 shown in FIG. 15 attain a state just before they come in contact with each other. The housings 101 and 102 and the terminals 104 and 105 are then substantially fitted to each other. Simultaneously, the housings 101 and 102 are locked by the locking means 131 and 132.

Subsequently, as shown in FIG. 18, the grip portion 118 of each of the sliders 103 is manually pulled in and is moved to a central portion of the recessed portion 101. Thus, the projected housing 102 approaches the recessed housing 101 by each of the cam tracks 127 and 127' engaged with the cam follower 122. The cam follower 122 comes in slide contact with the intermediate portion 127*b* having inclinations $\theta_1$ to $\theta_3$ so that the housings and the terminals are fitted to each other by a small force.

FIG. 19 shows a state of the completion of the fitting operation. The cam follower 122 is located in the terminal portions 127*c* and 127*c'* of the cam trcks 127 and 127', and the projection 124 is located between the engaging portions 117 on a central upper face of the holding rail 113 and the pair of sliders 103 are locked in the cover portion 107, resulting in a closed position thereof.

When the sliders 103 are moved from the opening position to the closed position, i.e., at a stage of the fitting operation of the housings 101 and 102, a force for floating or separating the sliders 103 from the cover portion 107 is generated due to the contct resistance of the plurality of male and female terminals 104 and 105. However, the housings are reliably joined to each other by the fitting operation between the holding groove 121 and the holding rail 113. Further, the pair of sliders 103 are symmetrically moved towards and away from each other between the opening and closed positions, so that the rotation moment transmitted to the projected housing 102 by the cam followers 122 on both sides of the sliders are cancelled, thereby smoothly fitting and separating the housings from each other without rattles.

As mentioned above, since the slider 103 are attached to the recessed housing 101 in advance, it is enough for an operator to simply operate the sliders so that it is not necessary to fir and separate the housings on one sides thereof as in the conventional connector, thereby fitting and separating the housings in a small limited space. The housings 101 and 102 can be detached or separated from each other by the operation reverse to the above operation.

FIG. 16 shows a graph showing the relation between stroke S and fitting force F when the housings 101 and 102 are fitted to each other. With respect to curve A, the fitting force is small in positions of inclinations $\theta_1$ and $\theta_2$ of the intermediate portion 127*b* of the cam track 127 as shown by curve portion $A_1$, and is rapidly increased along curve portion $A_2$ in a position of inclination $\theta_3$ by the substantial contact fitting of the male and female terminals 104 and 105, and reaches peak $A_3$, and then becomes constant at level of curve portion $A_4$ by dynamic friction, thereby completing the fitting operation.

Figure 20A:
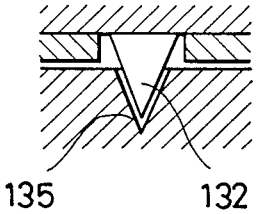
FIGS. 20A to 20C are cross-sectional views showing another embodiments of the respective cam follower and cam track.
Figure 20B:
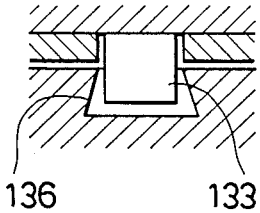
Figure 20C:
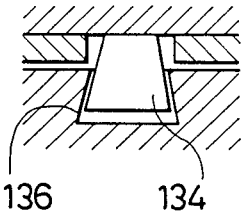
Figure 21:
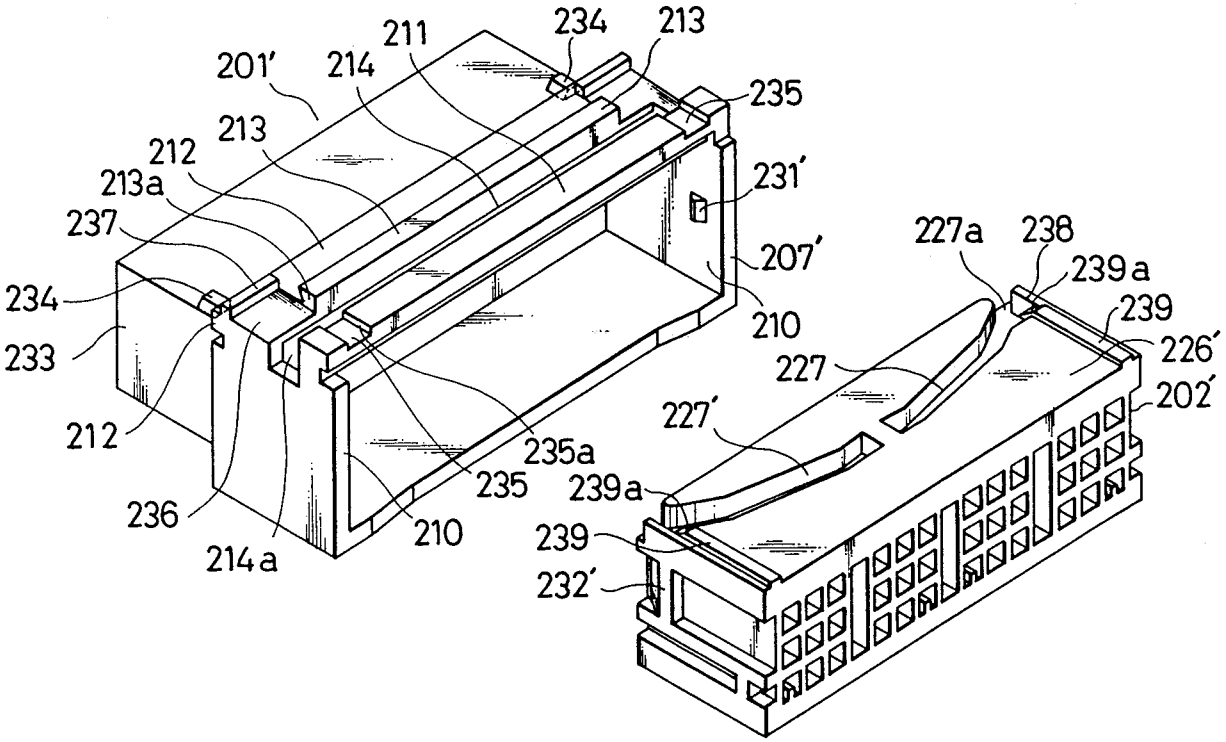
FIG. 21 is an exploded perspective view showing a multipolar connector in a third embodiment of the present invention.
Figure 22:
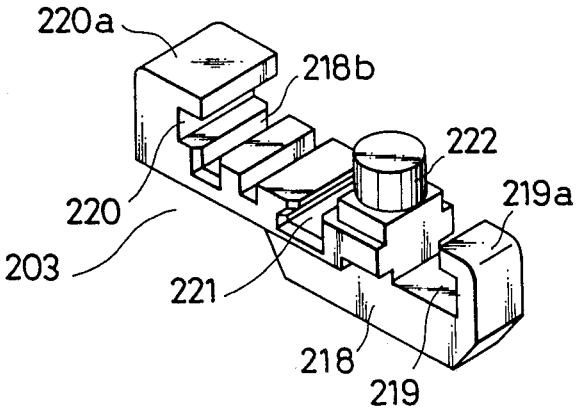
FIG. 22 is an enlarged perspective view of a slider seen from below.

FIGS. 20A and 20C show some embodiments of the shape in cross section of the cam follower and the cam track in which cam followers 132, 133 and 134 respectively have conical, cylindrical and trapezoidal shapes and corresponding cam tracks 135 and 136 have a triangular cross section and trapezoidal cross sections. In the structure of FIG. 20C having the trapezoidal cam follower and cam track, the joining force between the holding rail 113 and the holding groove 121 can be strengthened by the engagement of the slider and the cam track.

The above embodiment is described in relation to the contiguous cam tracks 127 and 127', but the respective terminal portions 127*c* and 127*c'* thereof may be independently seprated from each other. Further, the inclination of the intermediate portion 127*b* may be constnt. Further, even when the connecting portion from the inlet portion 127*a* to the terminal portion 127*c* is formed in the shape of an arc, the housings can be smoothly fitted and separated from each other. When the slider 3 has a sufficient rigidity and the number of polarities of connectors is relatively small, the holding rail 113 and the holding groove 121 may be omitted such that the guide rails 111 and 112 and the inserting grooves 119 and 120 also function as the holding rail and the holding groove. In this case, the engaging projections 115 to 117, etc., are disposed on the guide rail side.

As mentioned above, in accordance with the multipolar connector of the present invention, sliders constituting a cam mechanism for fitting and separating projected and recessed housings from each other are attached to one of the housings at any time, thereby fitting and separating the housings in a small limited space. Further, the sliders are symmetrically moved as a pair between opening and closed positions, the connector can be smoothly operated without rattles due to rotation moment, and the housings can be fitted and separated from each other by a small force by simultaneous slide movement of the sliders.

FIGs. 21 to 23D show a third embodiment of the present invention in which a pair of sliders can be relatively locked in an opening position.

In these figures, a cover portion 207' of a recessed housing 201' is formed as a rectangular frame having a size larger than that of a body 233 of the housing, and base seats 234 are projected in both end portions of an upper wall of the body 233. Engaging grooves 235 for a pair of sliders 203 and engaging slanting faces 236 are disposed on both sides of a forward guide rail 211 of the cover portion 207'. Each of the engaging slanting faces 236 has a gentle inclination backwardly increasing from an intermediate holding rail 213 towards the guide rail 212, and a guide projection 237 is disposed at a rear edge of the engaging slanting face 236 and is engaged with a recessed portion 218*b* of each of the sliders 203.

In cam tracks 227 and 227' formed in an upper wall 226' of the projected housing 202', a side wall 238 is vertically disposed in an inlet portion 227*a*, and a projection 239 is disposed inside the wall 238 and has a slanting face 239*a* to release the locking state of the housings.

A projection 231' for a provisional engagement is disposed on the inner face of an end wall 210 of the cover portion 207' of the recessed housing 201', and a corresponding projection 232' is disposed on both sides of the projected housing 202'.

In this embodiment, the pair of sliders 203 are attached to the guide rails 211, 212 and the holding rail 213 from an opening 214*a* of a slot 214, as in the former embodiment, but when the sliders reach the engaging grooves 235 by the sliding movement thereof, the sliders can be reliably locked in this position.

Figure 23A:
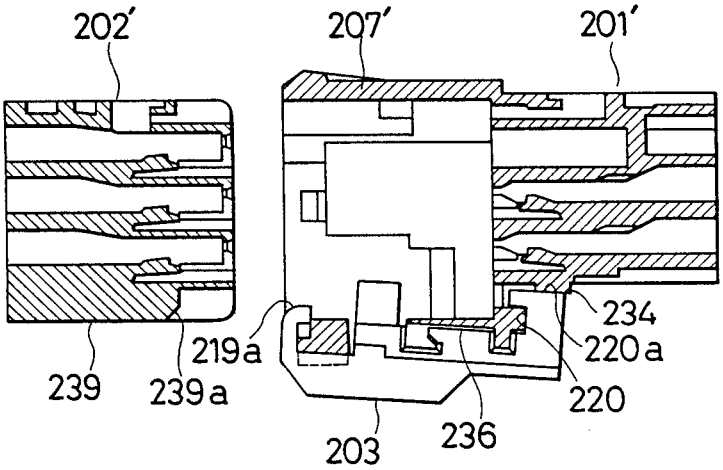
FIGS. 23A to 23D are cross-sectional views respectively showing operating states of the connector.

Namely, as shown in FIG. 23A, the slider 203 is lifted on the side of a backward inserting groove 220, and a bottom face 220*a* thereof is placed on the base seat 234 of the recessed housing 201'. Thus, the slider 203 attains a forwardly slanting state in the positions of the engaging slanting face 236 and the engaging groove 235, and the sides of the slider 203 contact a groove wall 235*a* of the engaging groove 235 and an end face 213*a* of the holding rail 213, so that the slider is reliably locked.

Figure 23B:
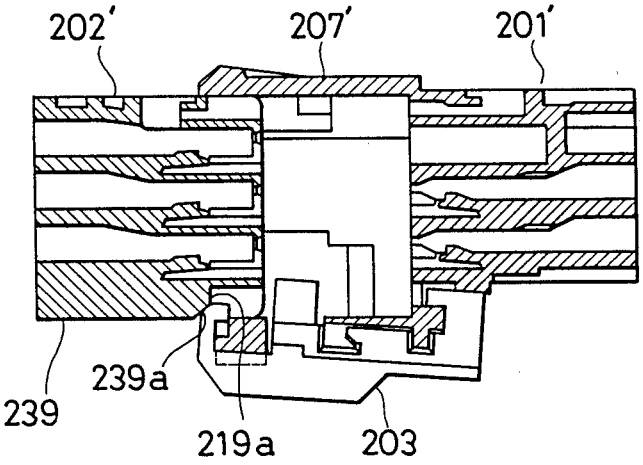

In this state, when the projected housing 202' is inserted into the cover portion 207', as shown in FIG. 23B, the slanting face 239*a* of the projection 239 for releasing the locking state contacts a bottom face 219*a* of the inserting groove 219 on the front side of the slider 203 so that the projected housing 202' is moved forwards while pressing the slider 203 upwards.

Figure 23C:
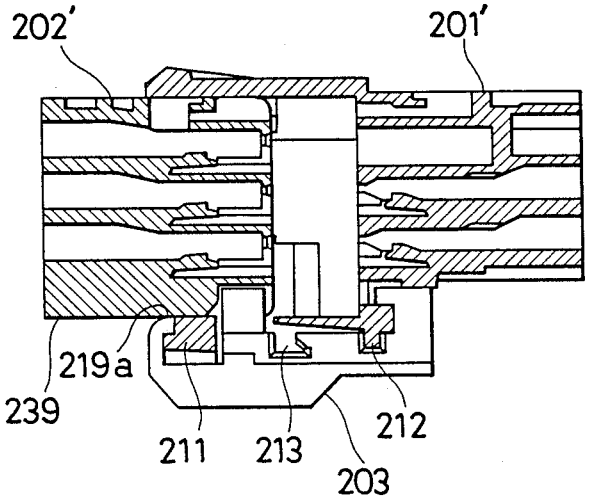

When the projection 232' for the provisional engagement of the projected housing 202' exceeds the projection 231' inside the cover portion and both housings 201' and 202' reaches a provisional engaging position, the bottom face 219*a* of the slider 203 is completely moved on the projection 239, so that the slider 203 attains a horizontal state as shown in FIG. 23C. Namely, the engagement of the slider 203 with the engaging groove 235, etc., is released, and the guide rails 211, 212, and the holding rail 213 can be moved.

Figure 23D:
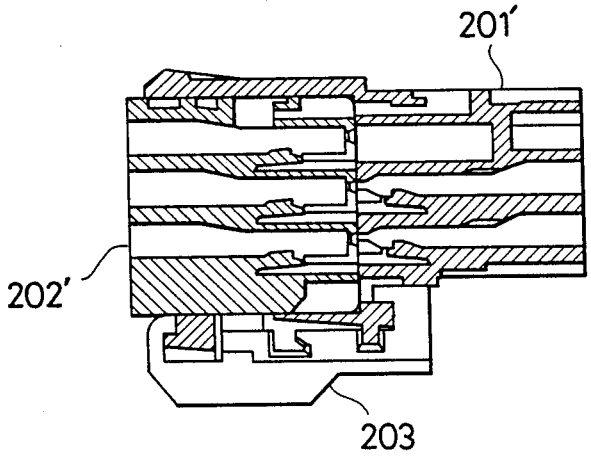

FIG. 23D shows a state in which the fitting operation of both housings 201' and 202' is completed. The fitting operation of both housings by each of the sliders 3 is similar to that in the embodiment shown in FIGS. 17 to 19.

The housings 201' and 202' are separated from each other in the operation reverse to the above operation. In this case, since the slider 203 contacts the side wall 238 in the upper wall 226' of the projected housing 202', the slider 203 is not detached from the cover portion 207'.

In this embodiment, the slider 203 can be reliably locked in the opening position, and the lock-holding force is strong, and the locking operation is simplified, and the locking state is automatically released by the fitting of the projected housing 202'.

FIG. 24A and FIGS. 25A to 25C show another embodiment of the present invention in which an operator can easily confirm the completion of the fitting operation of both housings by a pair of sliders.

Figure 24A:
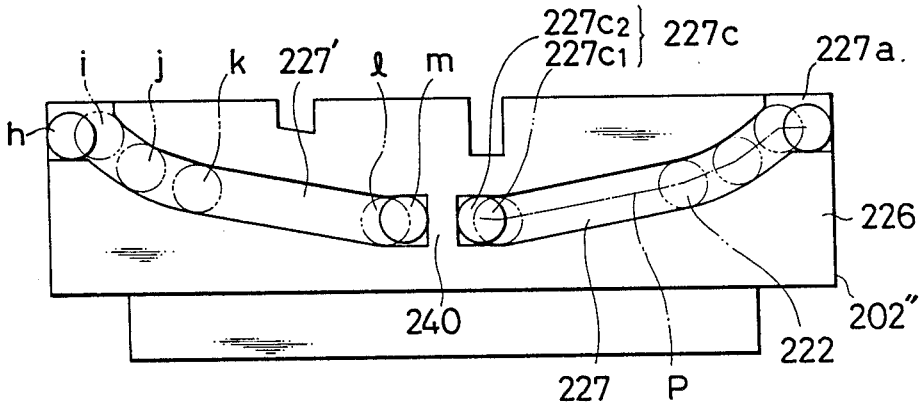
FIG. 24A is a plan view of a projected housing in accordance with another embodiment of the present invention.
Figure 24B:
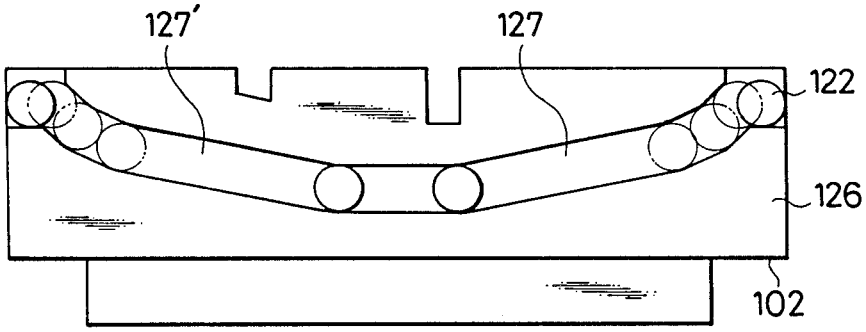
FIG. 24B is a plan view of the projected housing in the embodiment shown in FIG. 12 in comparison with the projected housing of FIG. 24A.
Figure 25A:
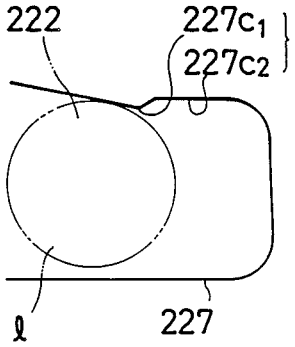
FIGS. 25A to 25C are views respectively enlarging main portions of FIG. 24A.
Figure 25B:
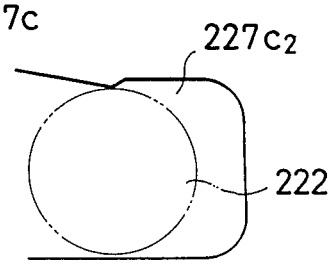
Figure 25C:
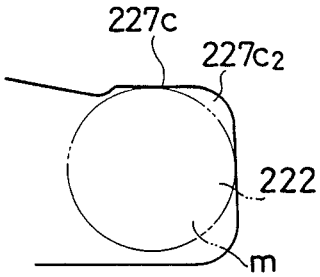

In FIG. 24A, a terminal portion 227*c* of each of the cam tracks 227 and 227' in the projected housing 202'' is separated from another terminal portion thereof by a partition wall 240. The terminal portion 227*c* has a narrow portion $227c_1$ and a wide portion $227c_2$ which constitutes a terminal of each cam track. A trace of a cam follower 222 at the fitting time of both housings is designated by P. FIG. 24B shows the relation between the cam follower 122 and each of the cam tracks 127 and 127' in the projected housing 122 in the embodiment shown in FIG. 12.

As mentioned before, the recessed and projected housings 101 and 102 are fitted to each other by the operation of each of the sliders 103 (see FIGS. 17 to 19). At this time, as shown in FIG. 24B, the cam follower 122 presses a forward inner wall of each of the cam tracks 127 and 127'. When the fitting of the housings is completed, as shown in FIGS. 12 and 14, each of the sliders is locked, thereby confirming the completion of the fitting operation. However, an operator cannot easily confirm the completion of the fitting operation since it is not easy for the operator to check the contact feeling of the fitting operation. When the engaging projections 117 are made large-sized and high to increase the contact feeling of the fitting operation, the sliders cannot be easily operated and may stop by such engaging projections, thereby causing an incomplete fitting operation.

Figure 26A:
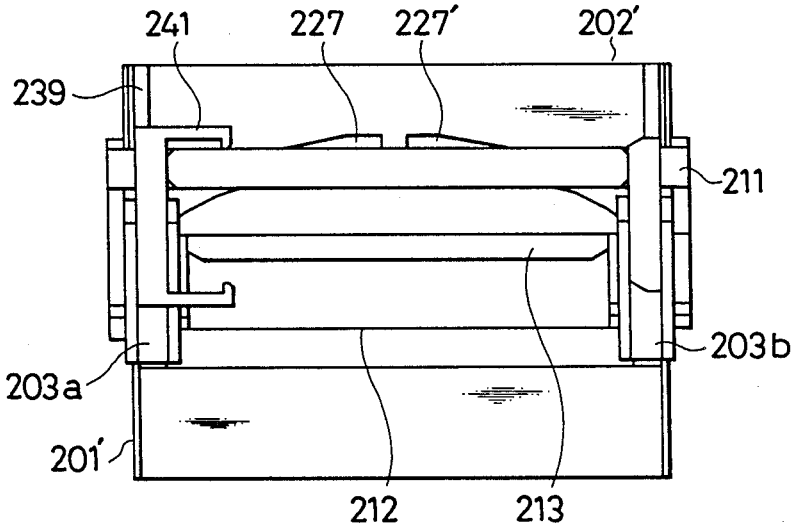
FIGS. 26A and 26B are plan views of a recessed housing in accordance with another embodiment of the present invention and respectively showing opening and closing positions of the slider.
Figure 26B:
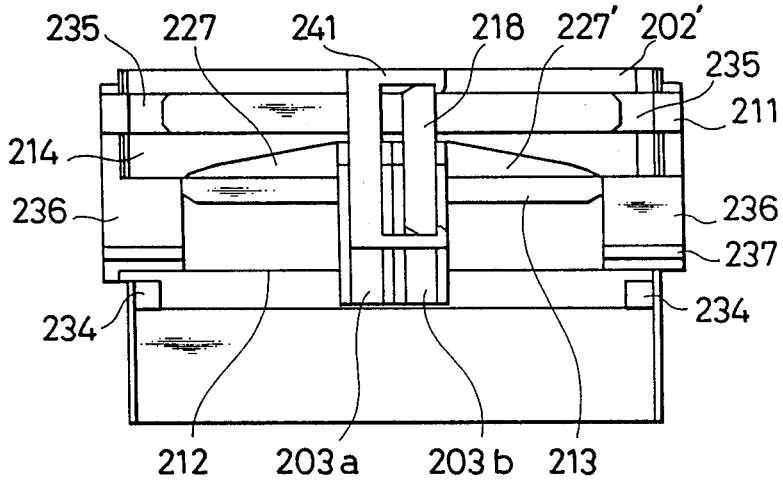
Figure 27A:
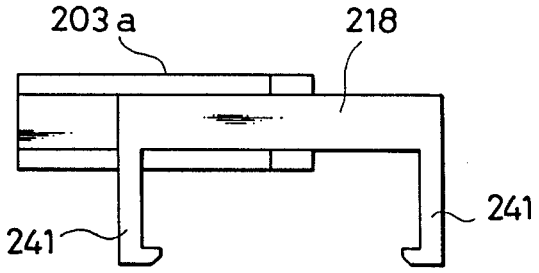
FIGS. 27A and 27B are respectively plan and side views showing the slider.
Figure 27B:
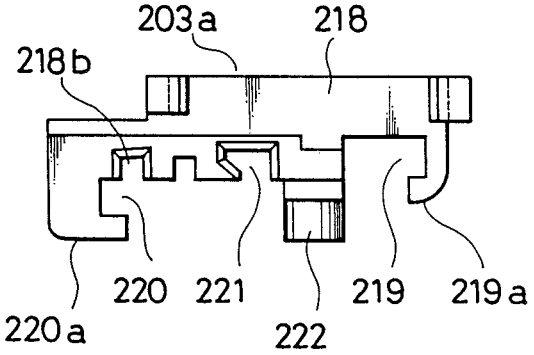
Figure 28A:
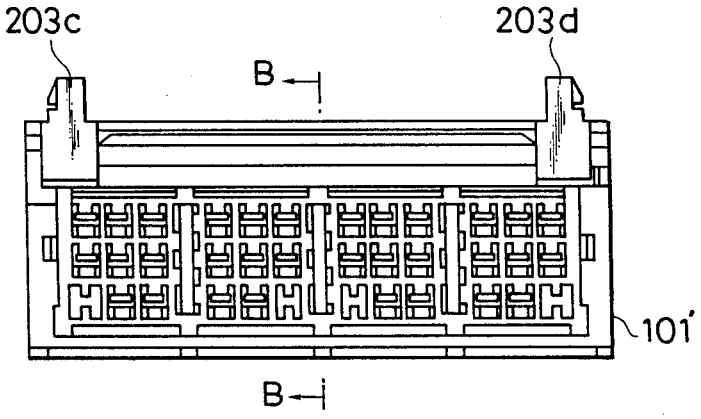
FIG. 28A is a rear view showing the recessed housing constituting the connector in accordance with another embodiment of the present invention.
Figure 28B:
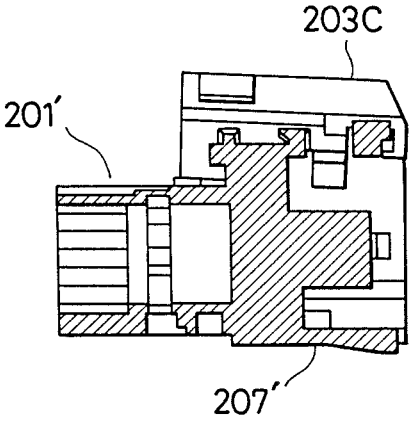
FIG. 28B is a cross-sectional view taken along line B—B of FIG. 28A.

To solve these problems, the cam follower 222 is moved from point h to point l in FIG. 24A. Further, as shown in FIGS. 26A to 26C, the sliding resistance of the cam follower 222 is rapidly increased in front of the narrow portion 227$c_1$, and when the cam follower 222 exceeds the narrow portion 227$c_1$, the cam follower 222 reaches the wide portion 227$c_2$ at point m, so that there is no sliding resistance of the cam follower. Accordingly, an operator can confirm the completion of the fitting operation with a moderate contact feeling.

FIGS. 26A and 26B and FIGS. 27A and 27B show another embodiment of the present invention in which a locking means is disposed between a pair of sliders so as to simultaneously confirm the completion of the fitting operation and hold the closed position of the sliders.

In these figures, a grip portion 218 is disposed in one slider 203*a* in the recessed housing 201', and a hook-shaped locking arm 241 engaged with a grip portion of the other slider 203*b* is projected on both sides of the grip portion 218 of the slider 203*a*.

In this case, when the fitting operation of both housings 201' and 202' is completed by the operation of the sliders 203*a* and 203*b* as shown in FIG. 26B, the locking arm 241 is engaged with and locked by the grip portion 218 of the slider 203*b*. Thus, the sliders 203*a* and 203*b* are held in the closed position, thereby confirming the completion of the fitting operation of both housings.

FIGS. 28A, 28B, 29A to 29C, and 30 show another embodiment of the present invention in which a pair of sliders can be engaged with a hole disposed in a panel when the fitting operation of both housings is completed.

In these figures, an engaging claw 242 is projected in each of a pair of sliders 203*c* and 203*d* attached to a cover portion 207' of the recessed housing 201', and has a convergent slanting face 242*a* on the outer face of each of the grip portions 218, and a panel fitting groove 243 is disposed below the engaging claw 242. The other portions of the sliders 203*c* and 203*d* and the recessed housing 201' are similar to those in the embodiment shown in FIGS. 21 to 23.

Figure 30:
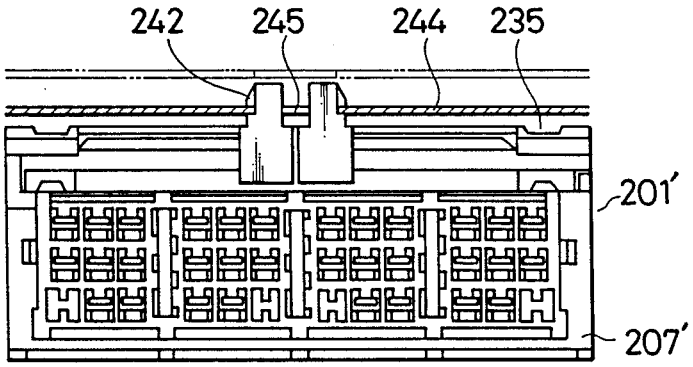
FIG. 30 is a view showing the operating state of the slider.
Figure 31A:
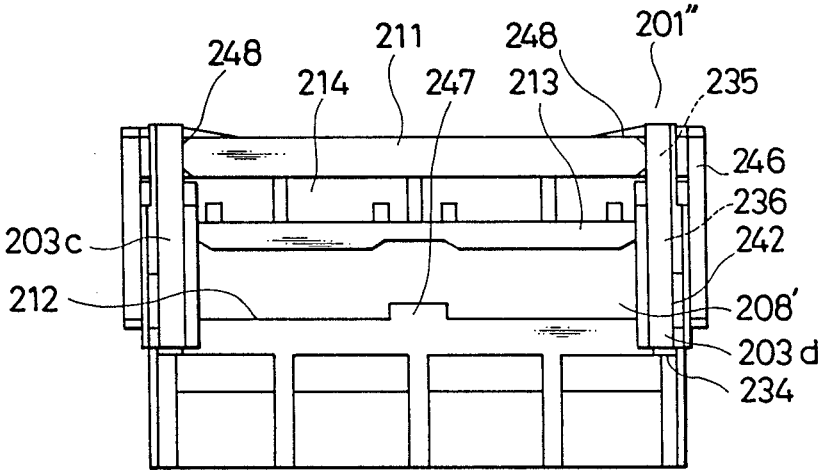
FIGS. 31A and 31B are respectively plan and front views of the recessed housing in accordance with another embodiment of the present invention.
Figure 31B:
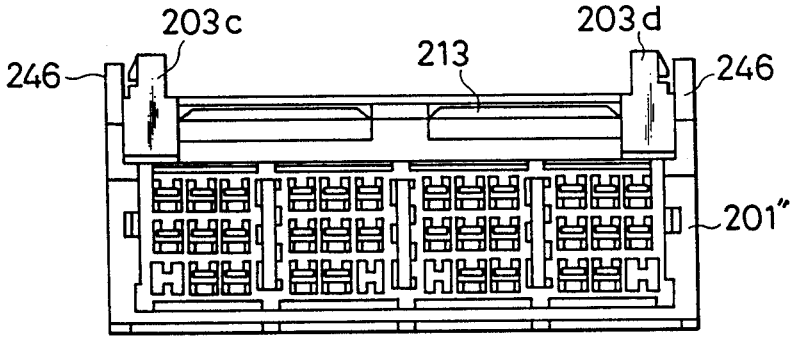

In this embodiment, as shown in FIG. 30, a hole 245 is disposed in a wall 244 of a chassis, a panel, various kinds of devices, and the engaging claw 242 of each of the sliders 203*c* and 203*d* is inserted into the hole 245 and can be engaged with the panel fitting groove 243, thereby simultaneously confirming the completion of the fitting operation of both housings and holding the closed position of the sliders 203*c* and 203*d* and engging the housings with each other.

FIGS. 31A, 31B, 32A to 32C and 33 show another embodiment of the present invention in which sliders attached to the recessed housing are prevented from being detached therefrom and rattles of the housings can be prevented when the housings are engaged with a panel.

In these figures, the pair of sliders 203*c* and 203*d* are attached to the recessed housing 201" as mentioned before. As clearly seen from FIGS. 31A and 31B, a positioning wall 246 is projected at both ends of an upper side wall 208' of a cover portion 207' and has a height approximately equal to that of each of the sliders 203*c* and 203*d*. An opening 214*a* of a slot 214 is closed, and instead of this, a notch 247 for attaching each slider thereof is disposed in a central portion of a backward guide rail 212. The width of the notch 247 is set to receive single slider 203*c*. A tapered slider engaging portion 248 is formed in both end portions of the forward guide rail 211.

Figure 32A:
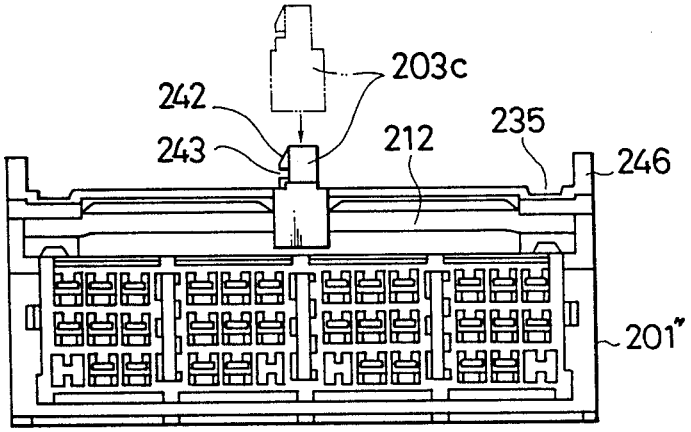
FIGS. 32A to 32C are views for explaining a state in which the slider is attached to the housing.
Figure 32B:
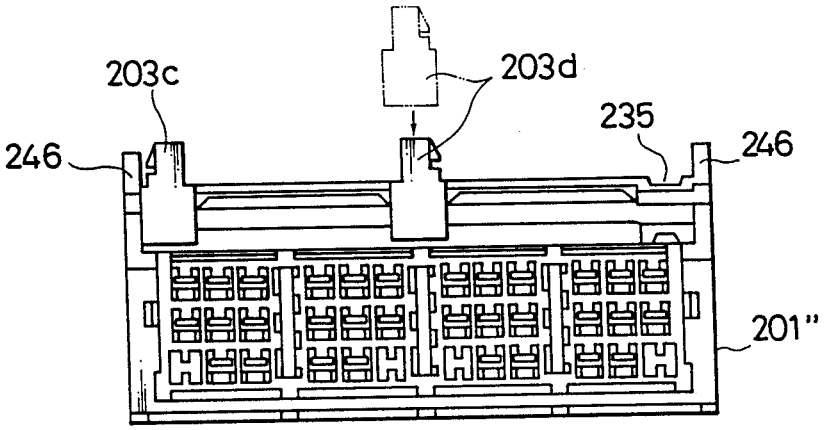
Figure 32C:
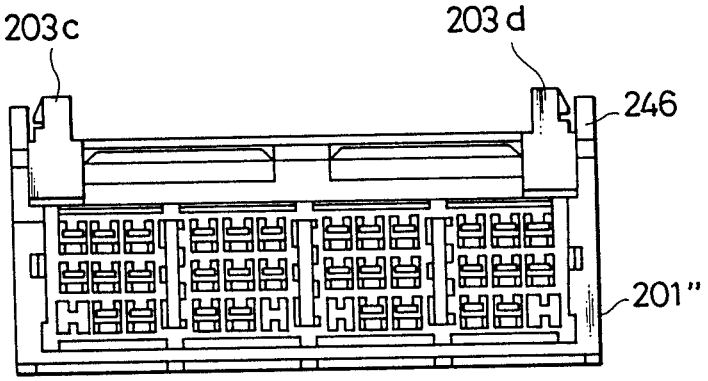

In this embodiment, when the sliders 203*c* and 203*d* are attached, as shown in FIG. 32A, the slider 203*c* is inserted from the notch 247 of the backward guide rail 212 and is moved on the lefthand side of FIG. 32A, and the slider 203*d* is similarly inserted as shown in FIG. 32B. When the sliders 203*c* and 203*d* are respectively slided on both sides of FIG. 32A, the movement of the sliders 203*c* and 203*d* is stopped by the slider engaging portion 248 as shown in FIG. 32C. Similar to the embodiment shown in FIGS. 23A to 23D, both sliders are engaged in a forward slanting state with the base seat 234, the engaging slanting face 236 and the engaging groove 235.

Figure 33:
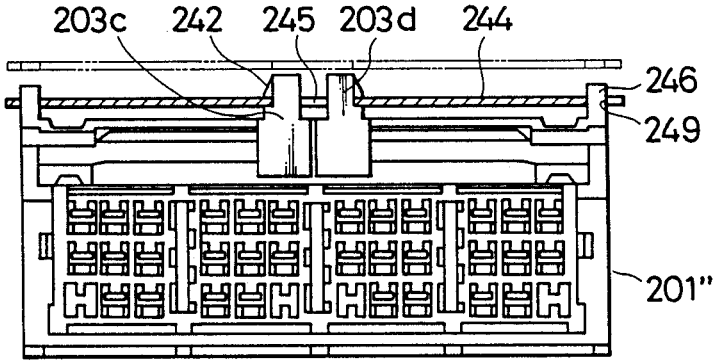
FIG. 33 is a view for explaining the operating state of the slider.

When the fitting of the recessed and projected housings 201" and 202' is completed by the operation of the sliders 203*c* and 203*d*, as shown in FIG. 33, the engaging projection 242 of each of the sliders is inserted into and engaged with the hole 245 of the wall 244, and the positionins wall 246 is inserted into a slit 249 of the wall 244, thereby generating no rattles of the housings. When the sliders 203*c* and 203*d* are in the closed position, the notch 247 is in a state in which one of the sliders is mounted on the notch 247 so that there is no fear that the sliders are detached from the guide rails 211 and 212.

Figure 29A:
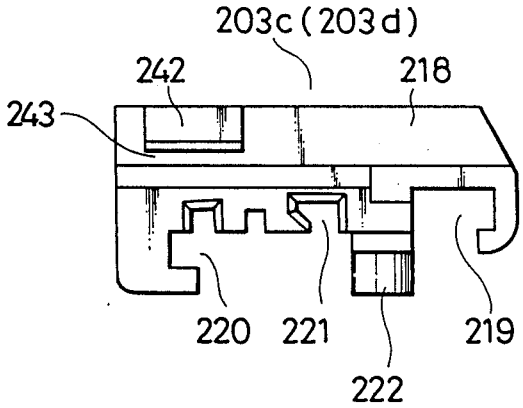
FIGS. 29A and 29C are respectively front, right side and plan views of the slider.
Figure 29B:
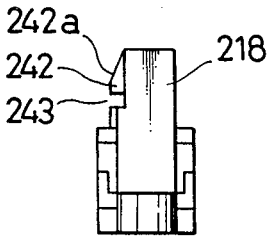
Figure 29C:
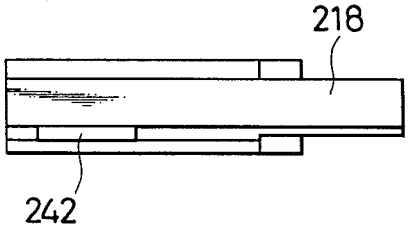
Figure 34:
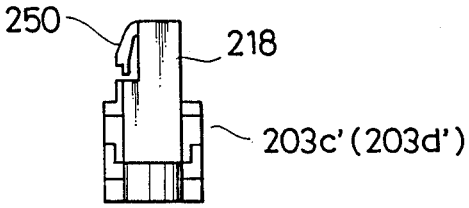
FIG. 34 is a front view of the slider in accordance with another embodiment of the present invention.
Figure 35A:
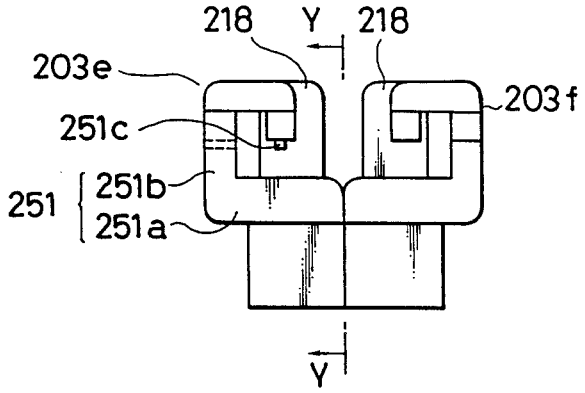
Figure 35B:
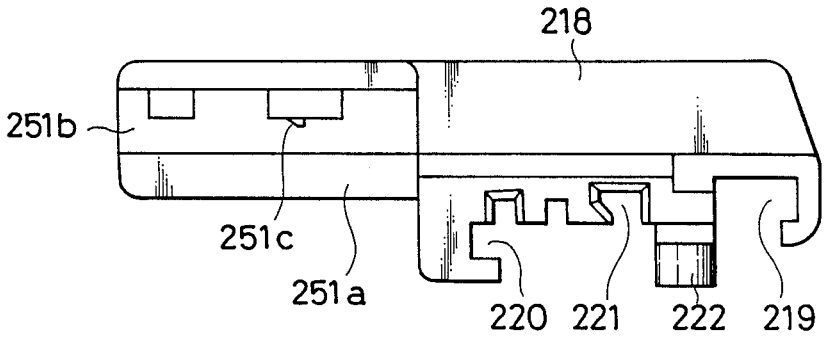
Figure 35C:
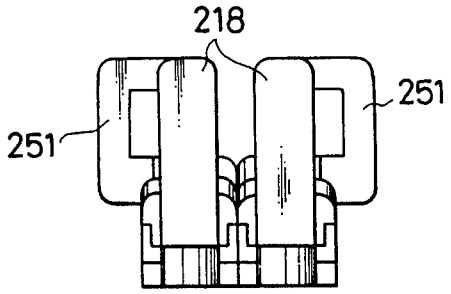
Figure 35D:
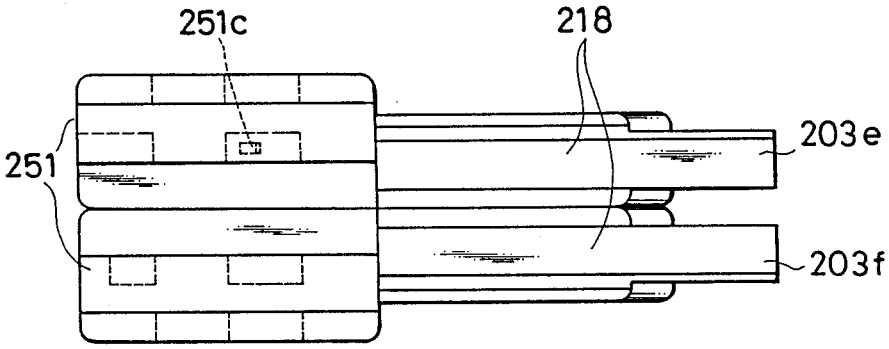

FIG. 34 shows another embodiment of the present invention in which a flexible clip claw 250 is disposed instead of the engaging claw 242 of the slider 203*c* of FIG. 29A. When a pair of sliders 203*c'* and 203*d'* provided with the clip claw 250 are used, the housings can be detachably engaged with the hole 245 of the wall 244 in FIG. 30, thereby easily checking and replacing the housings.

FIGS. 35A to 35D, 36A to 36C and 37 show another embodiment of the present invention in which an engaging member for confirming the fitting operation of housings is disposed in a pair of sliders and is of a plug-in type, and is detachably engageable with a receiving member disposed on a wall face of a panel, a device such as an electrical connecting box, etc.

In these figures, the pair of sliders 203*e* and 203*f* are formed by an engaging member 251 composed of a base plate portion 251*a* and a support portion 251*b* having a U-shaped cross section in a rear portion of respective grip portions 218, and an engaging claw 251*c* is projected on a free end face of the support portion 251*b* as shown in FIGS. 35A to 35D. The engaging claw 251*c* may be disposed in either one of the sliders 203*e* and 203*f*.

Figure 36A:
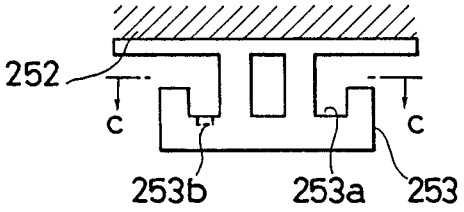
FIGS. 36A to 36C are respectively front and side views showing a receiving member with respect to the slider, and a cross-sectional view taken along line C—C of FIG. 36A.
Figure 36B:
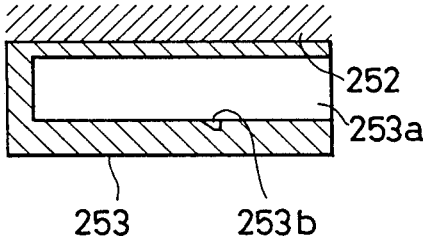
Figure 36C:
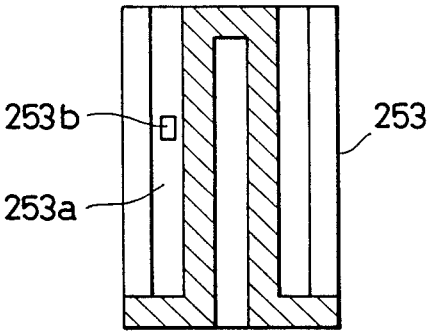

A receiving member 253 is projected on a wall face of an electrical connecting box 252 and has a plug-in groove 253*a* for the engaging member 251. An engaging groove 253*b* engaged with the engaging claw 251*c* is disposed in a groove bottom of the plug-in groove 253*a* as shown in FIGS. 36A to 36C.

Figure 37:
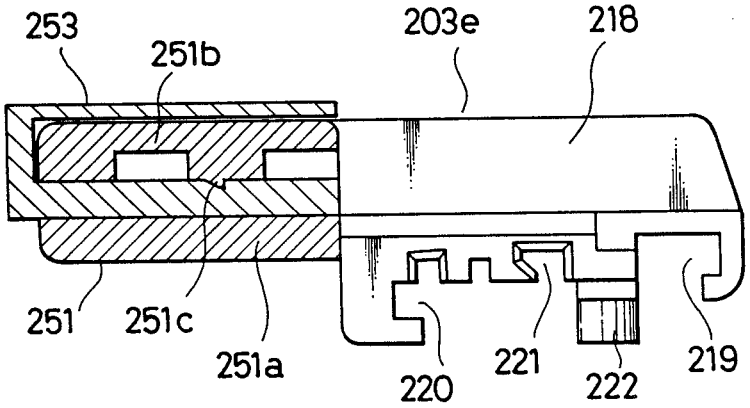
FIG. 37 is a partially cross-sectional view showing engaging states of the slider and the receiving member.

In this embodiment, when the pair of sliders 203*e* and 203*f* contact each other as shown in FIG. 35, i.e., the fitting operation of both housings is completed and the sliders are in the closed position, the engaging member 251 can be inserted into the receiving member 253 as shown in FIG. 37, thereby locking the sliders by the engagement between the engaging claw 251*c* and the engaging groove 253*b*.

As mentioned above, in accordance with the present invention, in addition to the effects mentioned in the former embodiments, when a means for locking a pair of sliders in opening and closed positions is disposed, it is not necessary to set the sliders at the beginning of the fitting operation, thereby preventing the incomplete fitting and detachment of the housings.

Further, when the completely fitted connector is engaged with a wall of a panel, an electronic device, etc., in a vehicle, rattles are prevented from being generated when the vehicle is running, thereby simultaneously performing the confirmation of the fitting state and the prevention of the incomplete fitting and the locking of both housings.

What is claimed is:

1. A multipolar connector comprising:

male and female terminals disposed in recessed and projected housings and electrically connected to each other by fitting the recessed and projected housings to each other;

guide rail means disposed in one of the recessed and projected housings;

slider means slidably attached to the guide rail means and having a cam follower means and moved along the guide rail means so that the recessed and projected housings are moved towards and away from each other;

a space disposed in said one of the recessed and projected housings and allowing the movement of the cam follower means; and guide groove means disposed in the other of the recessed and projected housings and engaged with the cam follower means through said space.

2. A multipolar connector as claimed in claim 1, wherein the guide rail means is disposed in the recessed housing, and the guide groove means is disposed in the projected housing.

3. A multipolar connector as claimed in claim 1, wherein the recessed housing has a cover portion for receiving the projected housing, and the guide rail means has a pair of parallel guide rails disposed in a side wall of the cover portion in a direction perpendicular to the longitudinal direction of the terminals.

4. A multipolar connector as claimed in claim 1, wherein the cam follower means is disposed on the lower face of the slider means.

5. A multipolar connector as claimed in claim 3, wherein said space is disposed in the cover portion and the guide groove means is disposed in the projected housing.

6. A multipolar connector as claimed in claim 2, wherein the slider means comprises a pair of sliders, and the guide groove means comprises a pair of cam tracks slantingly extending backwards and having inlet portions at both ends of a fitting face of the projected housing fitted to the recessed housing.

7. A multipolar connector as claimed in claim 6, wherein an engaging member is disposed in the pair of sliders and is engaged with a wall of a panel, etc.

8. A multipolar connector as claimed in claim 7, wherein, when the pair of sliders are moved from an opening position to a closed position, the multipolar connector can be engaged with the wall by the engaging member.

9. A multipolar connector for fitting a projected housing having a plurality of female terminals and a recessed housing having a plurality of male terminals to electrically connect the male and female terminals to each other, said connector comprising:

a pair of parallel guide rails disposed in a side wall of a cover portion of the recessed housing for receiving the projected housing and extending in a direction perpendicular to the axis of the terminals;

slider means slidably attached to the guide rails;

a cam follower disposed on the lower surface of the slider means;

a space disposed in the cover portion and allowing the movement of the cam follower; and guide groove means disposed in a side wall of the projected housing and engaged with the cam follower through the space;

said projected housing being moved towards and away from the recessed housing by moving the slider means along the guide rails.

10. A multipolar connector as claimed in claim 9, wherein the guide groove means slantingly extends backwards from a fitting face of the projected housing fitted to the recessed housing.

11. A multipolar connected as claimed in claim 9, wherein said guide groove means comprises a pair of cam tracks slantingly extending backwards and respectively having inlet portions disposed at both ends of a fitting face of the projected housing fitted to the recessed housing.

12. A multipolar connector as claimed in claim 11, wherein an engaging member engaged with a wall of a panel, etc., is disposed in a pair of sliders.

13. A multipolar connector as claimed in claim 12, wherein the connector can be engaged with the wall by the engaging member when the pair of sliders are moved from an opening position to a closed position.

* * * * *